US009586155B2

(12) United States Patent
Hong et al.

(10) Patent No.: US 9,586,155 B2
(45) Date of Patent: Mar. 7, 2017

(54) TOY VEHICLE TRACK WITH MULTIPLE TOY VEHICLE LAUNCH

(71) Applicant: Mattel, Inc., El Segundo, CA (US)

(72) Inventors: Brian Hong, Valencia, CA (US); Glenn Yu, San Marino, CA (US); Windsor Williams, Culver City, CA (US)

(73) Assignee: Mattel, Inc., El Segundo, CA (US)

( * ) Notice: Subject to any disclaimer, the term of this patent is extended or adjusted under 35 U.S.C. 154(b) by 116 days.

(21) Appl. No.: 14/504,920

(22) Filed: Oct. 2, 2014

(65) Prior Publication Data

US 2015/0097044 A1 Apr. 9, 2015

Related U.S. Application Data

(60) Provisional application No. 61/886,494, filed on Oct. 3, 2013.

(51) Int. Cl.
*A63H 18/02* (2006.01)
*A63H 18/14* (2006.01)
*A63H 18/16* (2006.01)

(52) U.S. Cl.
CPC ..... *A63H 18/026* (2013.01); *A63H 18/14* (2013.01); *A63H 18/16* (2013.01)

(58) Field of Classification Search
CPC .... A63H 17/00; A63H 17/004; A63H 17/008; A63H 18/00; A63H 18/021; A63H 18/023; A63H 19/00; A63H 19/15
USPC ..... 238/10 R, 10 A, 10 B, 10 C, 10 F; 446/429, 430
See application file for complete search history.

(56) References Cited

U.S. PATENT DOCUMENTS

| | | | | |
|---|---|---|---|---|
| 1,706,065 | A | 3/1929 | Jenkins | |
| 2,400,175 | A | 5/1946 | Suyat | |
| 3,540,153 | A | 11/1970 | Aoki | |
| 3,762,095 | A * | 10/1973 | Merino | A63H 18/02 446/430 |
| 3,777,391 | A | 12/1973 | Barcus et al. | |
| 3,797,164 | A | 3/1974 | Glass et al. | |
| 4,016,674 | A | 4/1977 | Resnick et al. | |
| 4,108,437 | A | 8/1978 | DeAnda et al. | |
| 4,146,991 | A | 4/1979 | Sano | |
| 4,267,661 | A | 5/1981 | Hanson et al. | |
| 4,291,878 | A | 9/1981 | Nagel et al. | |
| 4,418,495 | A | 12/1983 | Kennedy et al. | |
| 4,433,504 | A | 2/1984 | Terui | |
| 5,254,030 | A * | 10/1993 | Ostendorff | A63H 18/026 124/26 |

(Continued)

*Primary Examiner* — R. J. McCarry, Jr.
(74) *Attorney, Agent, or Firm* — Edell, Shapiro & Finnan, LLC

(57) ABSTRACT

The toy vehicle track system includes a first track section, a second track section, a third track section, a trigger configured to initiate a launch of a first toy vehicle and a second toy vehicle, and a toy vehicle launcher operatively coupled to the trigger and configured to launch the first toy vehicle onto the first track section and configured to launch the second toy vehicle onto the second track section upon operation of the trigger. The third track section is configured to receive the first toy vehicle from the first track section and configured to receive the second toy vehicle from the second track section such that the first toy vehicle and the second toy vehicle simultaneously travel on the third track section.

20 Claims, 16 Drawing Sheets

(56) References Cited

U.S. PATENT DOCUMENTS

| | | | |
|---|---|---|---|
| 5,460,560 | A | 10/1995 | Liu |
| 5,525,085 | A | 6/1996 | Liu |
| 7,549,906 | B2 | 6/2009 | Bedford et al. |
| 7,651,398 | B2 | 1/2010 | Ostendorff et al. |
| 7,794,301 | B2 | 9/2010 | Ostendorff et al. |
| 7,857,679 | B2 | 12/2010 | O'Connor et al. |
| 7,934,970 | B2 | 5/2011 | O'Connor |
| 7,946,903 | B2 | 5/2011 | Sheltman |
| 7,963,821 | B2 | 6/2011 | Ostendorff |
| 8,006,943 | B2 | 8/2011 | O'Connor |
| 8,016,639 | B2 | 9/2011 | Jobe |
| 8,043,139 | B2 | 10/2011 | Jobe |
| 8,192,246 | B2 | 6/2012 | Ostendorff et al. |
| 8,298,035 | B2 | 10/2012 | O'Connor |
| 8,323,069 | B2 | 12/2012 | Nuttall et al. |
| 8,382,553 | B2 | 2/2013 | O'Connor |
| 8,430,712 | B2 | 4/2013 | O'Connor et al. |
| 2005/0191938 | A1 | 9/2005 | Sheltman et al. |
| 2005/0287918 | A1 | 12/2005 | Sheltman et al. |
| 2011/0294396 | A1 | 12/2011 | O'Connor et al. |
| 2012/0164914 | A1 | 6/2012 | O'Connor et al. |

* cited by examiner

TOY VEHICLE TRACK WITH MULTIPLE TOY VEHICLE LAUNCH

CROSS-REFERENCE TO RELATED APPLICATIONS

This application claims priority under 35 U.S.C. §119(e)(1), to U.S. Provisional Application Ser. No. 61/886,494, filed on Oct. 3, 2013, the entire contents of which are incorporated herein.

FIELD

This disclosure relate generally to toy vehicle tracks and toy vehicle playsets and more particularly to toy vehicle tracks that provide for the launching of more than one vehicle.

BACKGROUND

Toy vehicle track sets are a source of amusement and activity for children and adults alike. Utilizing one or more track sections arranged to form a path, toy vehicles are driven about the track set. In order to increase play value of the track sets, various track amusement features have been added to the track sets, including loops, jumps, turns, launchers and the like.

Some toy vehicle track sets may include several basic elements. For example, the track itself which is typically formed to define some sort of travel path and is fabricated having sidewalls or other structures which confine a toy vehicle to the track. Another element of some toy vehicle track sets is the toy vehicle which varies from free wheeling unpowered vehicles to toy vehicles which have some source of loco-motion or power.

Some toy vehicle track sets may include a vehicle launcher. In toy vehicle playsets utilizing free wheeling toy vehicles, a gravity launcher may be used. In some toy vehicle playsets, a spring loaded toy vehicle launchers may be for free wheeling toy vehicles. Launchers may be provided which may be described as "hold and release" launchers in which the vehicle is restrained as the system is readied (e.g., the toy vehicle is placed and held in a gravitational pull state or in a spring loaded force state) after which the toy vehicle is released to traverse the track.

Some known launchers do not allow for controlled vertical launch. Other known toy vehicle track sets do not include the controlled release of more than one toy vehicle. Thus, there is a need for a track set that includes a vehicle launcher that allows for a controlled multiple vehicle launch.

SUMMARY

One embodiment includes a toy vehicle track system. The toy vehicle track system includes a first track section, a second track section, a third track section, a trigger configured to initiate a launch of a first toy vehicle and a second toy vehicle, and a toy vehicle launcher operatively coupled to the trigger and configured to launch the first toy vehicle onto the first track section and configured to launch the second toy vehicle onto the second track section upon operation of the trigger. The third track section is configured to receive the first toy vehicle from the first track section and configured to receive the second toy vehicle from the second track section such that the first toy vehicle and the second toy vehicle simultaneously travel on the third track section.

Another embodiment includes a toy vehicle launcher. The toy vehicle launcher includes a first launch member configured to launch a first toy vehicle, a second launch member configured to launch a second toy vehicle, and a switch operably coupled to the first launch member and the second launch member, the switch configured to select a launch order for the first toy vehicle and the second toy vehicle.

Still another embodiment includes a method of operating a toy vehicle launcher. The method includes inserting a first toy vehicle on the first launch member, inserting a second toy vehicle on the second launch member, selecting a launch order associated with the first toy vehicle and the second toy vehicle, and triggering a launch of the first toy vehicle and the second toy vehicle by the toy vehicle launcher.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limiting of the example embodiments and wherein.

DETAILED DESCRIPTION OF THE EMBODIMENTS

Figure 1:
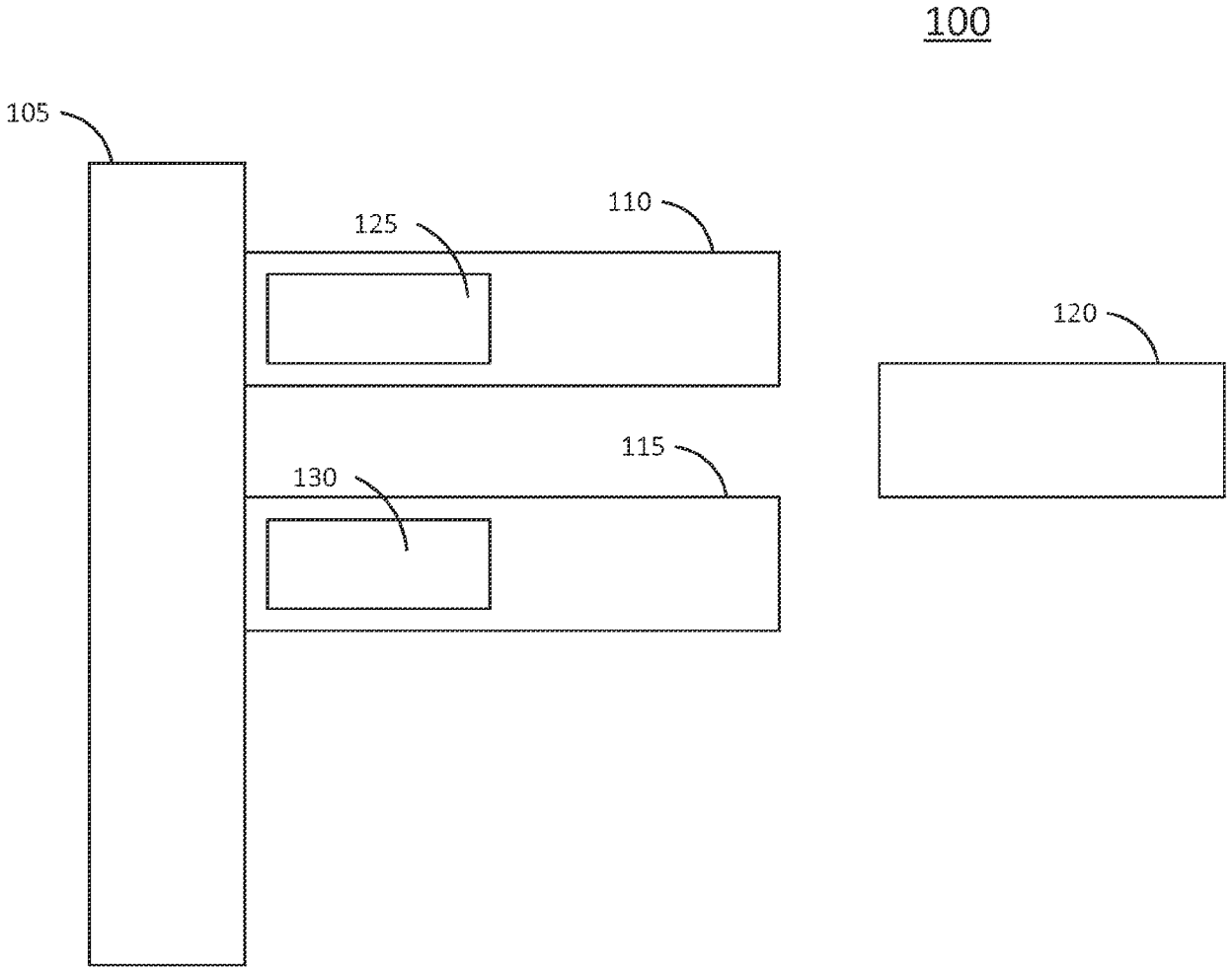
FIG. 1 is a schematic block illustration of a toy track set according to at least one example embodiment.

While example embodiments may include various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims. Like numbers refer to like elements throughout the description of the figures.

FIG. 1 is a block illustration of a toy track set according to at least one example embodiment. As shown in FIG. 1, the toy track set 100 includes a toy vehicle launcher 105 and track sections 110, 115 and 120. The toy vehicle launcher 105 may be configured to launch a first toy vehicle 125 onto a first track section 110 and configured to launch a second toy vehicle 130 onto a second track section 115. A third track section 120 may be configured to receive the first toy vehicle 125 from the first track section 110 and configured to receive the second toy vehicle 130 from the second track section 115 such that the first toy vehicle 125 and the second toy vehicle 130 simultaneously travel on the third track section 120.

Figure 2:
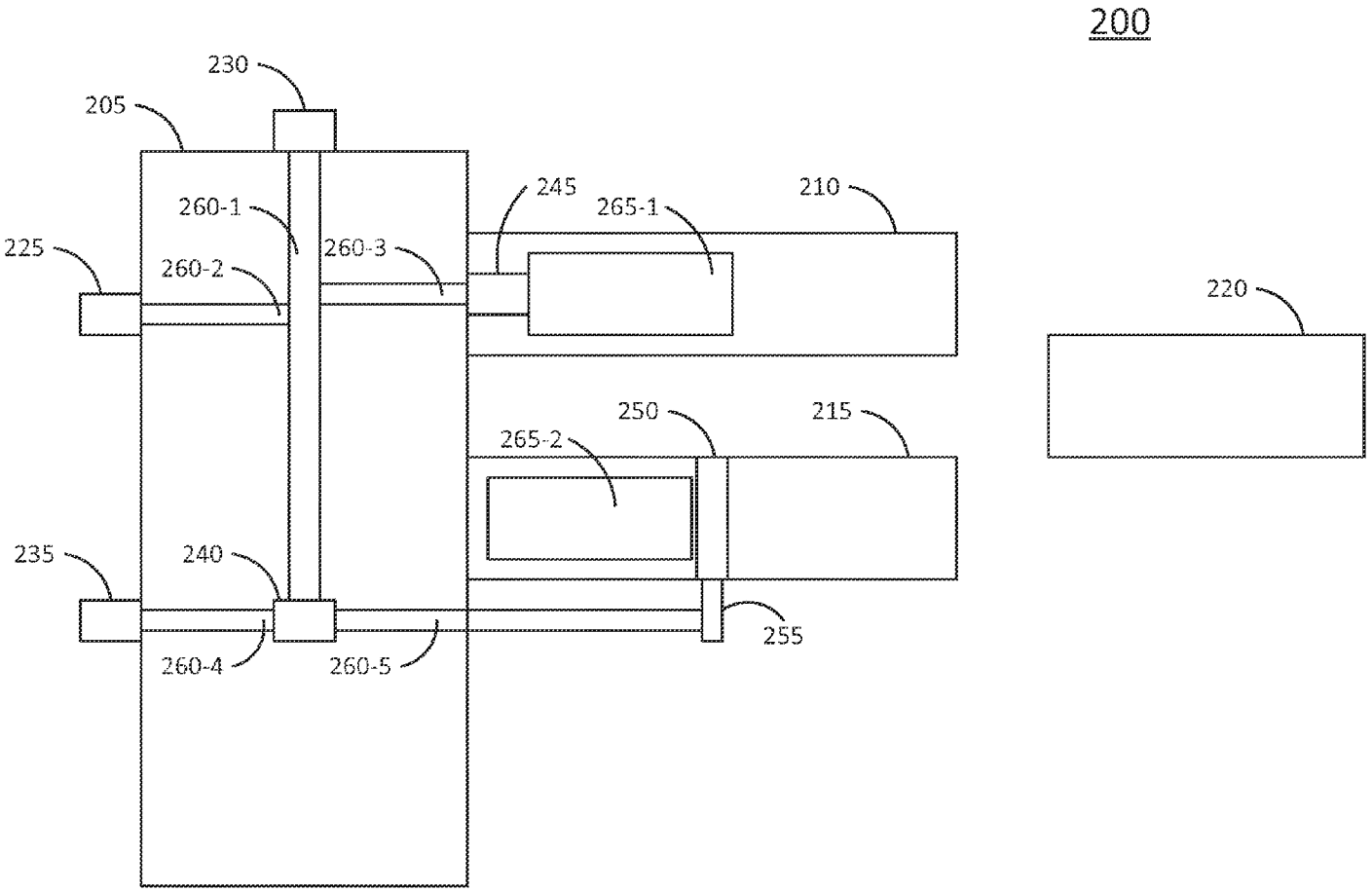
FIG. 2 is another schematic block illustration of a toy track set according to at least one example embodiment.

FIG. 2 is another block illustration of a toy track set according to at least one example embodiment. As shown in FIG. 2, the toy track set 200 includes a toy vehicle launcher 205 and track sections 210, 215 and 220. The toy vehicle launcher 205 may be configured to launch a first toy vehicle 265-1 onto a first track section 210 and configured to launch a second toy vehicle 265-2 onto a second track section 215. A third track section 220 may be configured to receive the first toy vehicle 265-1 from the first track section 210 and configured to receive the second toy vehicle 265-2 from the second track section 215 such that the first toy vehicle 265-1 and the second toy vehicle 265-2 simultaneously travel on the third track section 220.

The toy vehicle launcher 205 includes a latch mechanism 225, a trigger 230, a switch 235, a timing mechanism 240, launch members 245, 250, a retainer 255 and arms 260-1, 260-2, 260-3, 260-4, 260-5. The retainer 255 may be configured to hold (or help hold) the launch member 250 in a pre-launch (or ready to launch) position. The latch mechanism 225 may be configured to position the arms 260-1, 260-2, 260-3, 260-4, 260-5 such that the launch members 245, 250 hold (or help hold) the first toy vehicle 265-1 and the second toy vehicle 265-2 in a pre-launch (or ready to launch) position. The latch mechanism 225 may be further configured to hold (or help hold) the arms 260-1, 260-2, 260-3, 260-4, 260-5 in the aforementioned position. The trigger 230 may be configured to initiate movement of the arms 260-1, 260-2, 260-3, 260-4, 260-5 such that the launch members 245, 250 release the first toy vehicle 265-1 onto the first track section 210 and release the second toy vehicle 265-2 onto the second track section 215. The first toy vehicle 265-1 and the second toy vehicle 265-2 may be sequentially (e.g., one after the other) launched onto the first track section 210 and the second track section 215 respectively.

The timing mechanism 240 may be configured to delay a release of at least one of the first toy vehicle 265-1 and the second toy vehicle 265-2. For example, the timing mechanism 240 may be configured to cause the second toy vehicle 265-2 to be launched after the first toy vehicle 265-1. Alternatively, the timing mechanism 240 may be configured to cause the second toy vehicle 265-2 to be launched before the first toy vehicle 265-1. The switch 235 may be configured to select a launch order for the first toy vehicle 265-1 and the second toy vehicle 265-2. For example, timing mechanism 240 may include at least two time settings. For example, a first time setting of the at least two time settings may cause the second toy vehicle 265-2 to be launched after the first toy vehicle 265-1 and a second time setting of at least two time settings may cause the second toy vehicle 265-2 to be launched before the first toy vehicle 265-1. The switch 235 may be configured to alternately select one of the first time setting and the second time setting.

FIGS. 3A-3D are perspective illustrations of a toy track set according to at least one example embodiment. As shown in FIGS. 3A-3D, the toy track set 300 includes a toy vehicle launcher 305 and track sections 310, 315 and 320. The toy track set 300 may also include other track sections 375-1, 375-2, 375-3, 375-4, 375-5. For example, the toy track set 300 may include a bridge track section 375-1 including stands 380-1 and 380-2. For example, the toy track set 300 may include one or more turn track sections 375-2, 375-3. For example, the toy track set 300 may include one or more track exit sections 375-4, 375-5. The toy track set 300 may be raised off of a surface using a launch stand 370. The launch stand may also aid the toy vehicle launcher 305 if, for example, the toy vehicle launcher 305 is a gravity type launcher as shown. The toy track set 300 may also be raised off of the surface using stands 380-1, 380-2, 380-3.

Although FIGS. 3A-3D show the toy track set 300 as including other track sections 375-1, 375-2, 375-3, 375-4, 375-5, example embodiments are not limited thereto. For example, other track sections may include loops, ramps, tunnels, crosses, track crossovers and/or the like. For example, a track crossover may be defined by the bridge track section 375-1 and the stand 380-2 where the stand 380-2 may pivot so that the bridge track section 375-1 comes in contact with the turn track section 375-3. In addition, the pivot may be selectable. For example, one toy vehicle may be directed, via the bridge, to turn track section 375-2 while a second toy vehicle is directed, via the bridge, to turn track section 375-3.

Figure 3A:
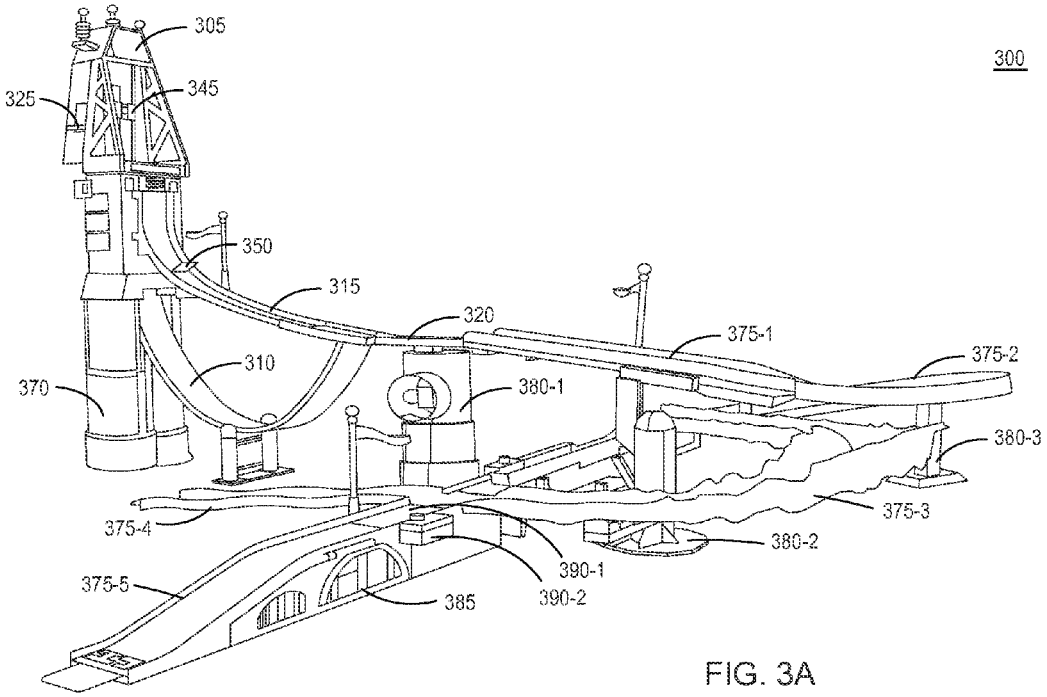
FIGS. 3A-3D are perspective illustrations of a toy track set according to at least one example embodiment.
Figure 3B:
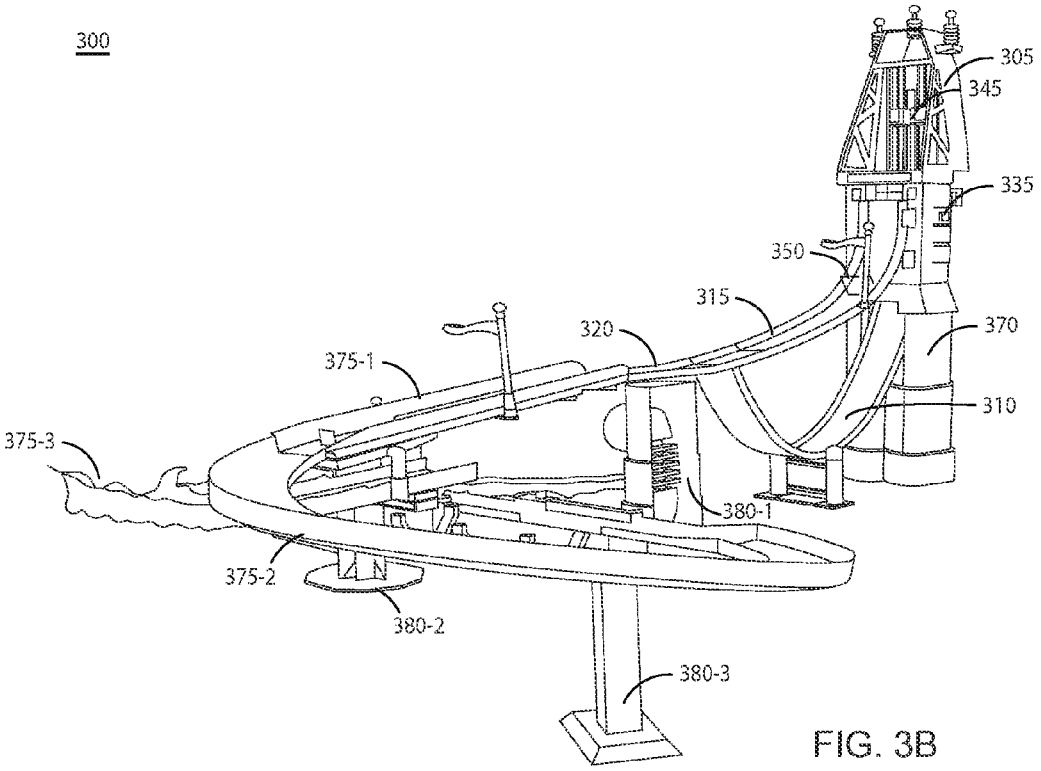
Figure 3C:
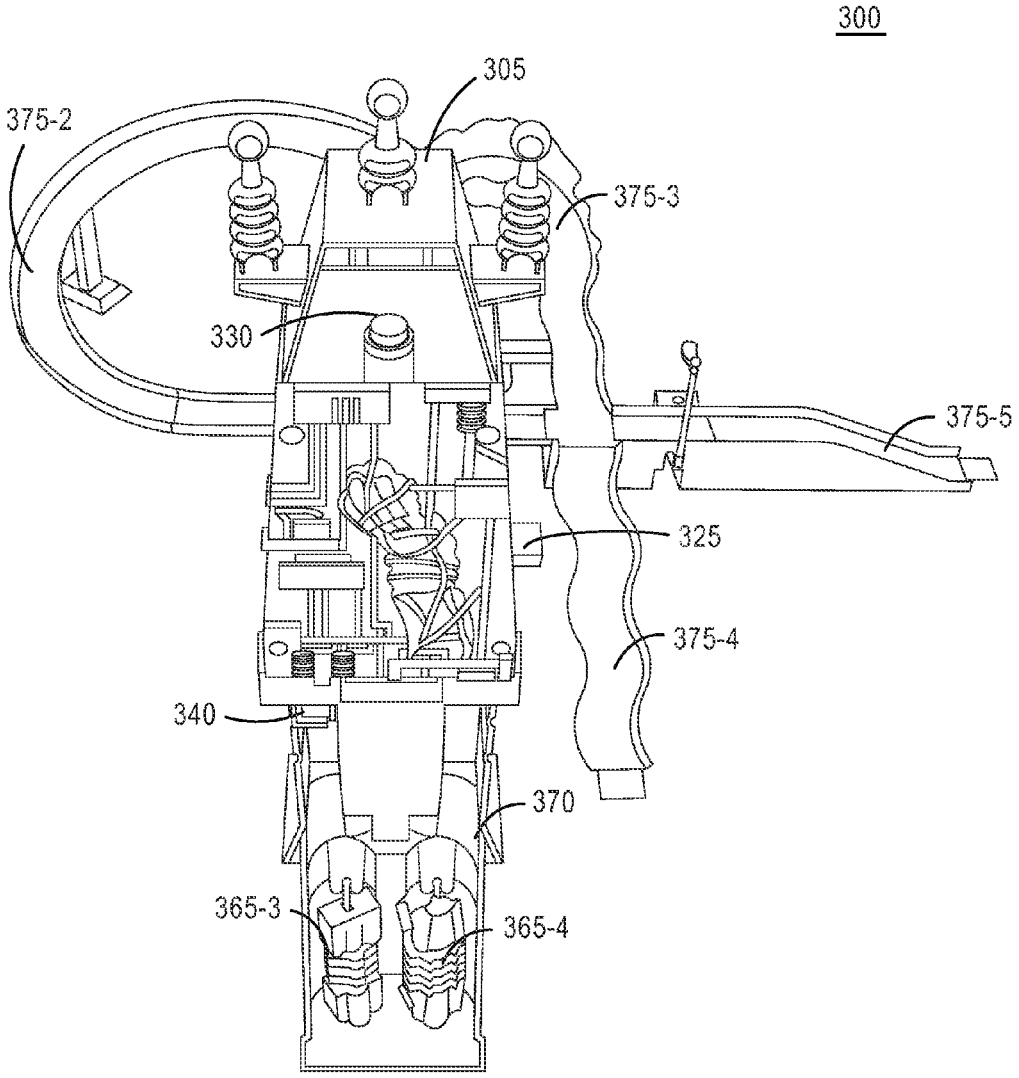
Figure 3D:
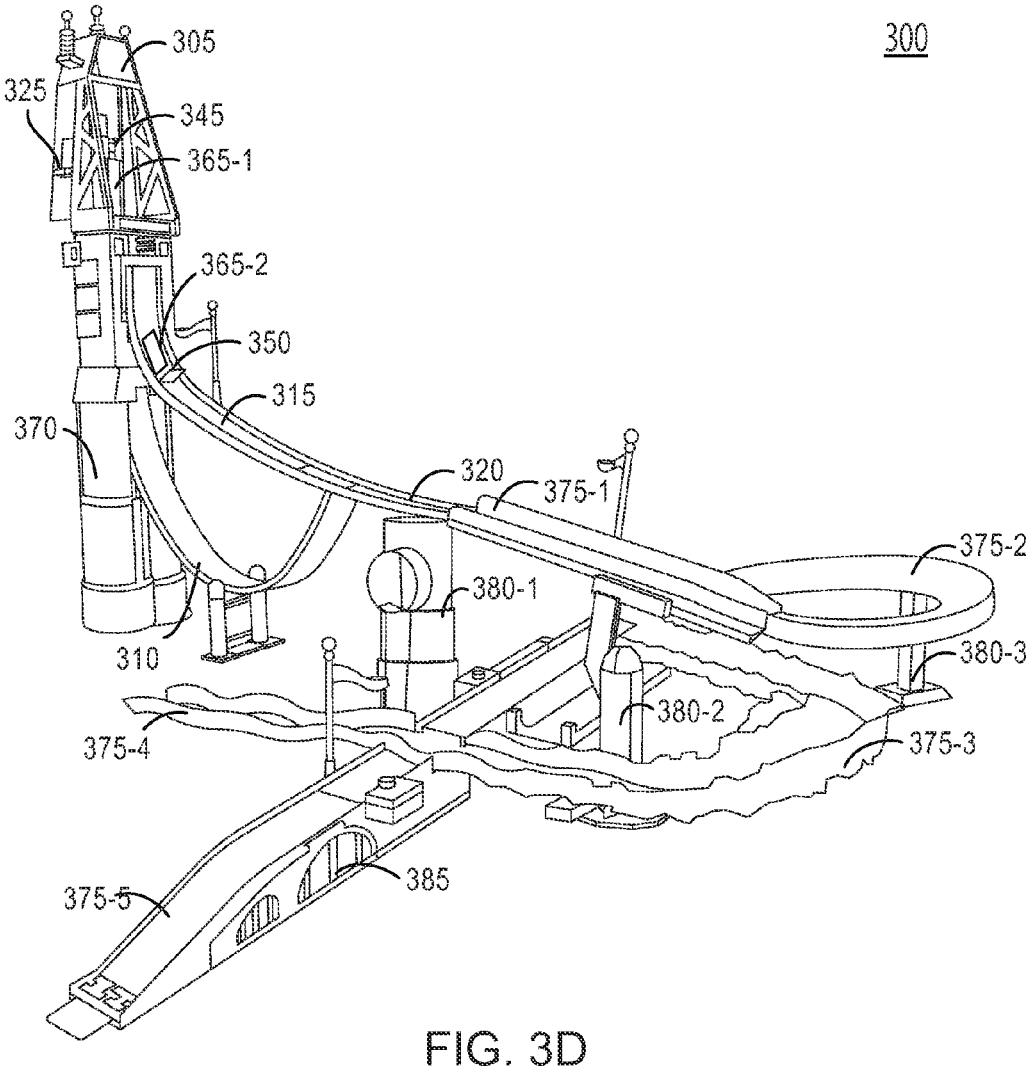

Further, the stands 370, 380-1, 380-2, 380-3 may be utilized for other functions. For example, as shown in FIG. 3C, launch stand 370 may be used to store toy vehicles 365-3, 365-4. Still further, track exit section 375-5 may be configured such that a toy vehicle is directed to tunnel 385 which is under track exit section 375-5 by positioning track section 390-1 using selection switch 390-2.

The toy vehicle launcher 305 includes a latch mechanism 325, a trigger 330, a switch 335, and launch members 345, 350. The toy vehicle launcher 305 may also include a timing mechanism (e.g., timing mechanism 240) and arms (e.g., arms 260-1, 260-2, 260-3, 260-4, 260-5) not shown. The latch mechanism 325, the trigger 330, and the launch members 345, 350 may be configured to operate together to launch toy vehicles 365-1, 365-2 onto track sections 310, 315, 320. The switch 335 may be configured to select a launch order for the first toy vehicle 365-1 and the second toy vehicle 365-2.

In some implementations, triggering a launch causes a first arm to drop. The drop may be gravity assisted. The drop may be resisted by a cam, a gear and/or friction. As the first arm drops, a first launch member may also drop (e.g., gravity assisted) and release or launch a first toy vehicle at some position of the first arm as the first arm drops. In addition, the first arm may come in contact with a second arm (e.g., as an element of a timing mechanism) that displaces at some rate of speed. At some position in the displacement of the second arm, an end of the second arm may come in contact with a third arm causing the third arm to move or rotate. As the third arm moves or rotates a second launch member may release or launch a second toy vehicle. The second toy vehicle may be released after the first toy vehicle or before the first vehicle based on the displacement of the second arm. The displacement may be based on when and/or where (on the second arm) the first arm comes in contact with the second arm.

Figure 4A:
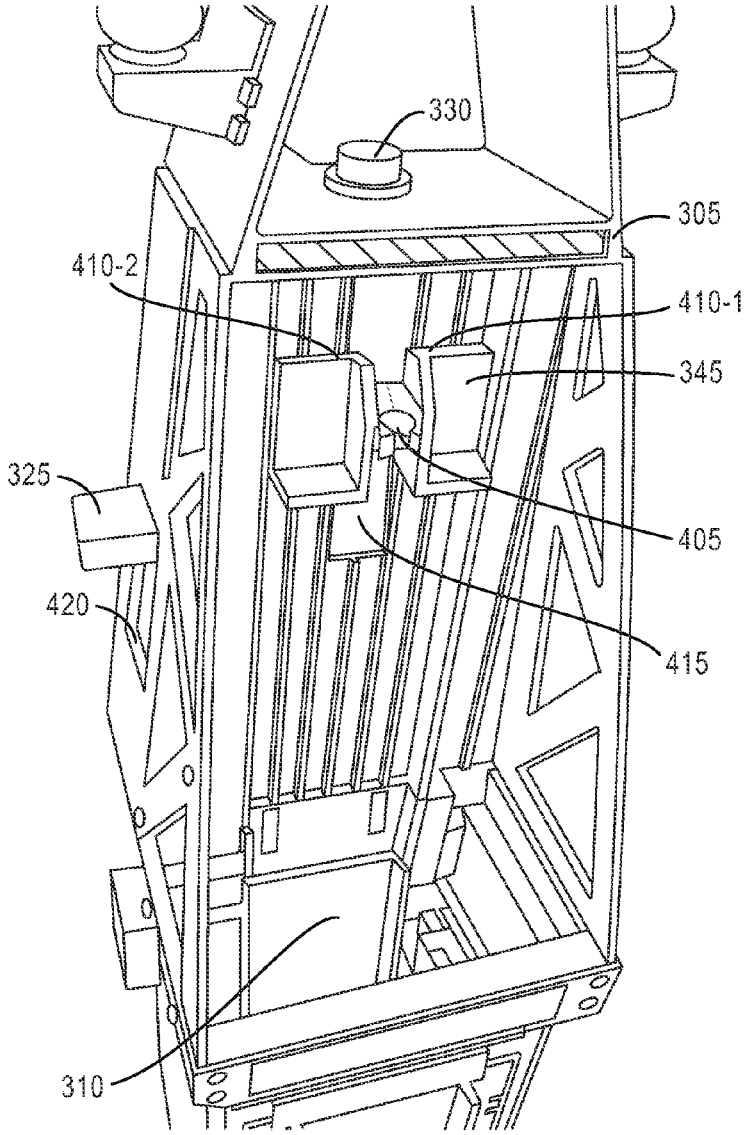
FIGS. 4A and 4B are perspective illustrations of a toy vehicle launcher according to at least one example embodiment.
Figure 4B:
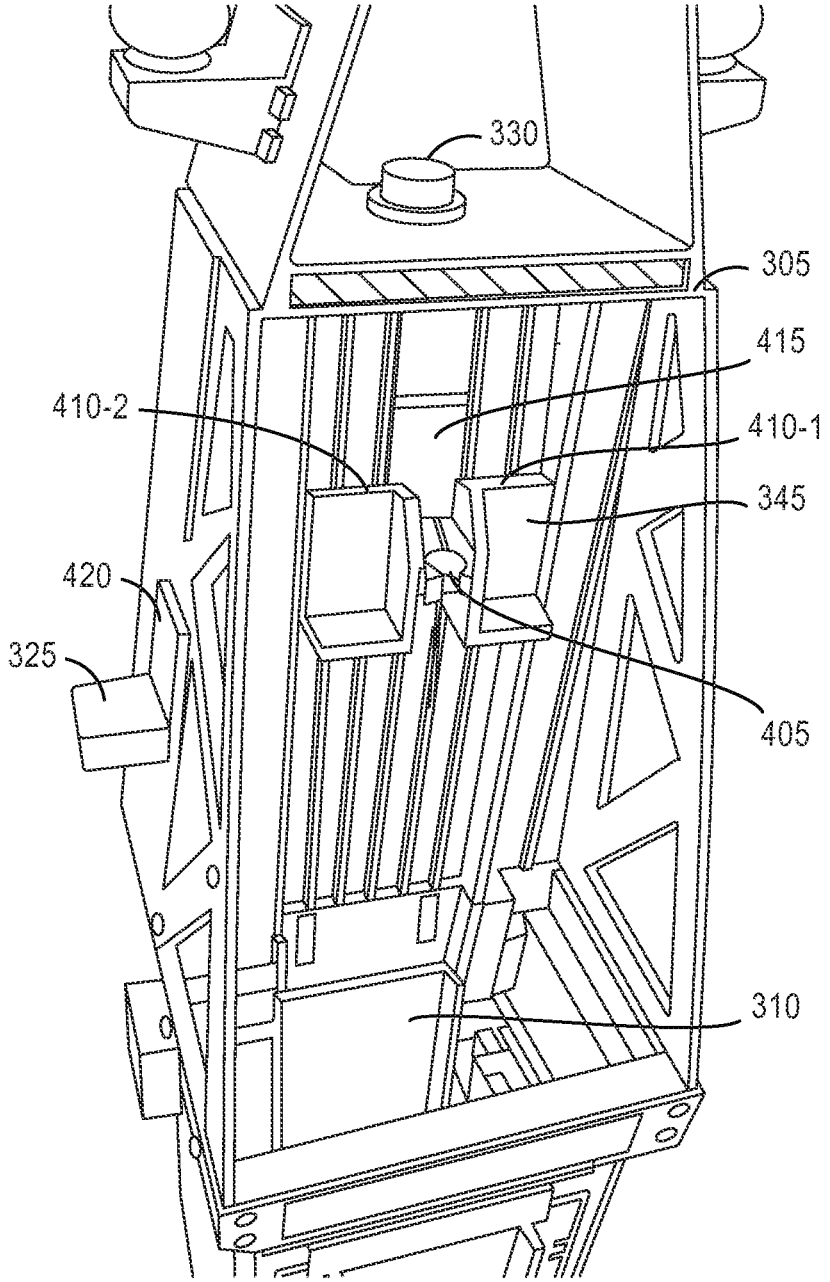

FIGS. 4A and 4B are perspective illustrations of the front portion of the toy vehicle launcher 305 showing the launch member 345 as illustrated in FIG. 3. As shown in FIGS. 4A and 4B, the toy vehicle launcher 305 includes the latch mechanism 325, the trigger 330, the launch member 345 and the track section 310. Further, the launch member 345 is in two pieces or split as sections 410-1, 410-2. A slot 405, defined by the launch member 345, may be configured to hold (or help hold) the first toy vehicle 365-1 in a pre-launch (or ready to launch) position.

The launch member 345 may be configured to move or slide over a length defined by a slot 415. In FIG. 4A, the launch member 345 is shown in a first position within the slot 415. In the first position, the launch member 345 may be configured to hold (or help hold) the first toy vehicle 365-1 in a pre-launch (or ready to launch) position. In FIG. 4B, the launch member 345 is shown in a second position within the slot 415. In the second position, the launch member 345 may be configured to release the first toy vehicle 365-1 onto the track section 310. For example, if the launch member 345 is in the first position, the first section 410-1 and the second section 410-2 may be in contact with each other such that the first toy vehicle 365-1 is held in a pre-launch (or ready to launch) position.

As the launch member 345 moves from the first position to the second position, the first section 410-1 and the second section 410-2 may separate. When the launch member 345 is in the second position (or substantially in the second position), the first section 410-1 and the second section 410-2 may be separated such that the first toy vehicle 365-1 releases onto the track section 310. As described in more detail below, the first toy vehicle 365-1 may to extend into or be received by the slot 405. As the launch member 345 moves from the first position to the second position, the first section 410-1 and the second section 410-2 may separate causing the slot 405 to get bigger. As a result, the first toy vehicle 365-1 drops from the launch member 345 onto track section 310.

In some implementations, the bottom of the slot 415 (e.g., corresponding to the second position of the launch member 345) is wider than top of the slot 415 (e.g., corresponding to the first position of the launch member 345). Accordingly, in this implementation, a weight of the first toy vehicle 365-1 causes the first section 410-1 and the second section 410-2 to separate which releases the first toy vehicle 365-1. In another implementation, the slot may have a guide (not shown) configured to separate the first section 410-1 and the second section 410-2 when the launch member 345 is in the second position and configured to close the first section 410-1 and the second section 410-2 when the launch member 345 is in the first position. In addition, the separation of the first section 410-1 and the second section 410-2 may be mechanically (such as via a spring) assisted. In still another implementation, the first section 410-1 and the second section 410-2 may move from the first position of the launch member 345 to the second position of the launch member 345 at a different rate of speed causing the first section 410-1 and the second section 410-2 to separate. The rate of speed may be set by a cam (not shown).

The latch mechanism 325 may be configured to position the launch member 345 in the first position. For example, the latch mechanism 325 may slide to the top of slot 420 in order to place the toy vehicle launcher 305 in the pre-launch (or ready to launch) position. The latch mechanism 325 may be further configured to hold (or help hold) the launch member 345 in the first position. For example, the latch mechanism 325 may be configured to move or slide over a length defined by a slot 420. A user may place the latch mechanism 325 as shown in FIG. 4A in order to position the launch member 345 into the first position. The trigger 330 may be configured to release the latch mechanism 325 such that the launch member 345 releases the first toy vehicle 365-1 onto the first track section 310 as discussed above. If the first toy vehicle 365-1 is released (e.g., the launch member 345 is in the second position), the latch mechanism 325 may be positioned at the bottom of slot 415 as shown in FIG. 4B.

In some implementations, an arm (not shown) on the inside of the toy vehicle launcher 305 is coupled to the latch mechanism 325 and the launch member 345. The arm may also be coupled to arm 515 described below. The arm may be released from the pre-launch (or ready to launch) position by trigger 330. The arm may fall due to gravity assisted by the weight of the first toy vehicle 365-1. The rate of descent of the arm may be reduced by a friction force (e.g., positioning the arm in contact with a fixed surface. The rate of descent of the arm may be reduced using gears configured to control the rate of decent and/or by an offset weight (e.g., a pulley system).

Figure 5A:
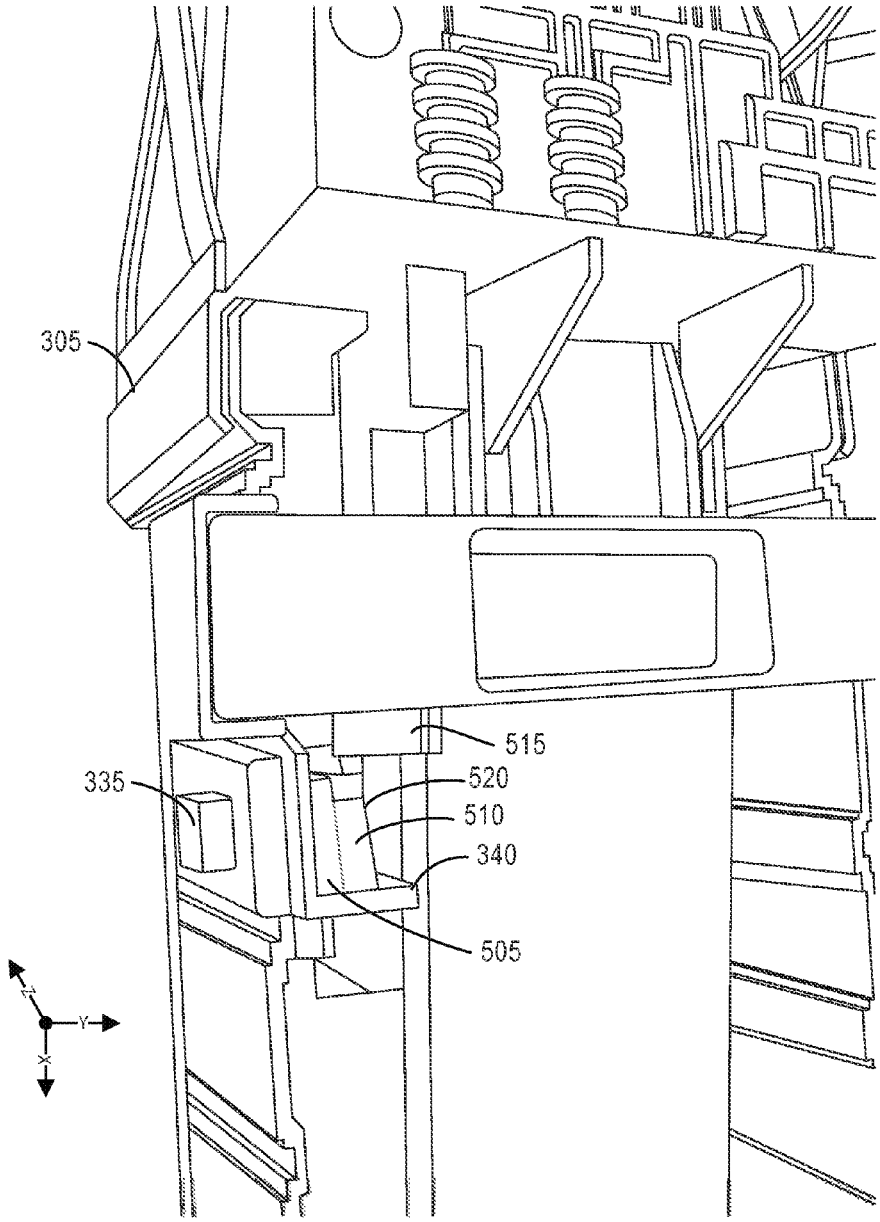
FIGS. 5A and 5B are other perspective illustrations of the toy vehicle launcher including a timing mechanism according to at least one example embodiment.
Figure 5B:
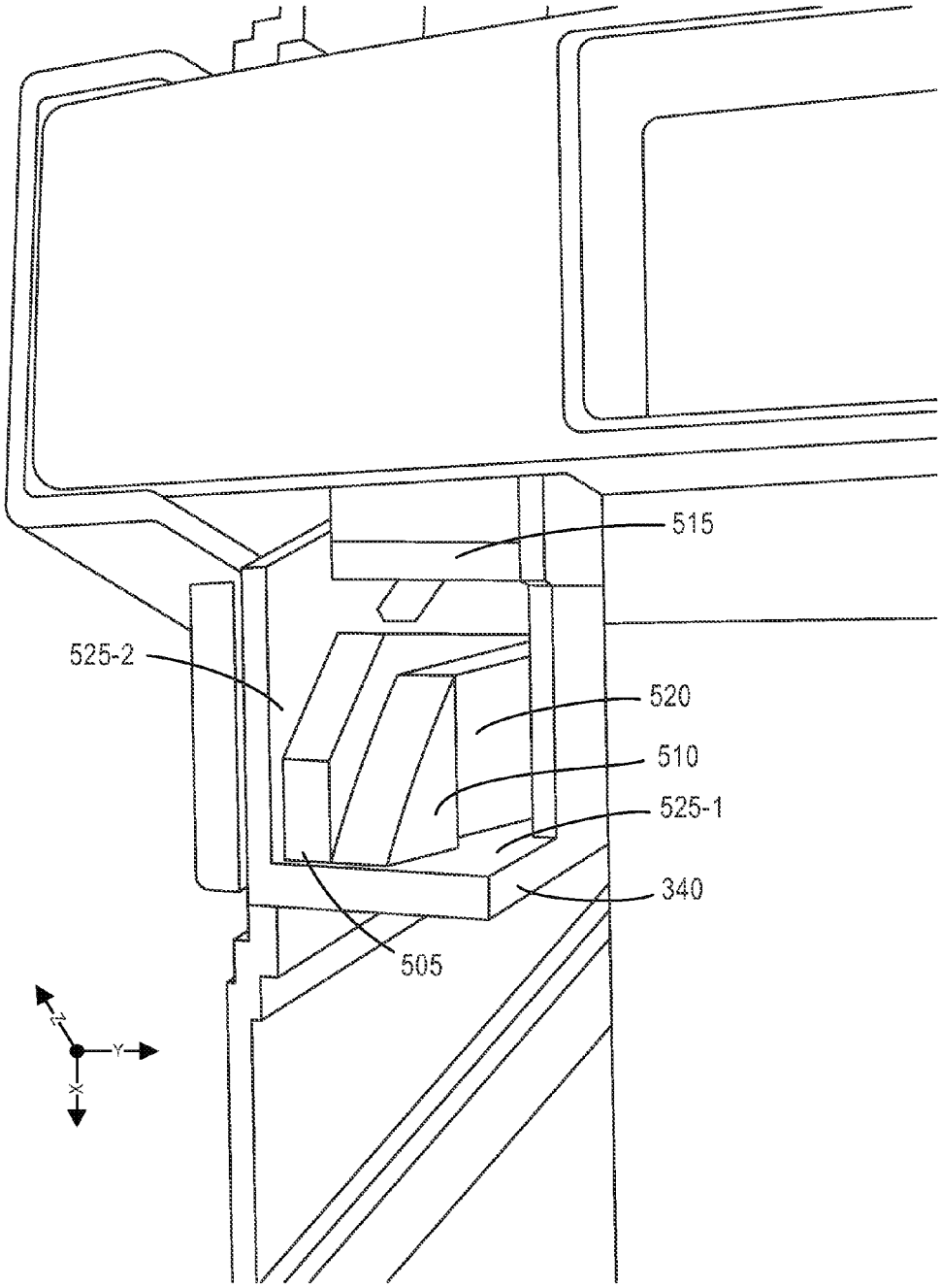

FIGS. 5A and 5B are other perspective illustrations of the toy vehicle launcher 305 including the timing mechanism 340 as illustrated in FIG. 3. As shown in FIG. 5, the toy vehicle launcher 305 includes the switch 335 and the timing mechanism 340. The timing mechanism 340 may include a movable arm 520 including a first portion 505 and a second portion 510. As described above, the timing mechanism 340 may be configured to cause the second toy vehicle 365-2 to be launched after the first toy vehicle 365-1. Alternatively, the timing mechanism 340 may be configured to cause the second toy vehicle 365-2 to be launched before the first toy vehicle 365-1.

Accordingly, the timing mechanism 340 may include two time settings defined by the first portion 505 and the second portion 510. During a toy vehicle launch sequence the launch member 345 moves from the first position to the second position and the arm 515 moves in the 'X' direction and comes in contact with one of the first portion 505 and the second portion 510. Further, the movable arm 520 has a curved or cam surface and arm 515 includes a projection that contacts the curved surface to force the movable arm 520 in the 'Z' direction. As a result, the movable arm 520 of the timing mechanism 340 is displaced in direction 'Z' (e.g., into the toy vehicle launcher 305). At some point in time during this sequence, the launch member 350 releases the second toy vehicle 365-2 onto the track 315.

In order to set the point in time that the second toy vehicle 365-2 is released onto the track section 315, the first portion 505 and the second portion 510 each have a corresponding time rate for displacing (displacement rate) the movable arm 520. For example, the first portion 505 is taller or larger than the second portion 510. Accordingly, the when the first portion 505 is disposed below the arm 515 the first portion 505 will come in contact with the arm 515 quicker than the second portion 510 would come in contact with the arm 515 when the second portion 505 is disposed below the arm 515. As a result, when the first portion 505 is selected (e.g., by switch 335) the second toy vehicle 365-2 is released onto track section 315 earlier than if the second portion 510 is selected.

In addition, each of the first portion 505 and the second portion 510 may have a slope or angle relative to the arm 515. The slope or angle may determine the displacement rate. For example, a small slope or angle may displace the timing mechanism 340 faster than a large slope or angle. In other words, a slope or angle of 35 degrees may displace the timing mechanism 340 faster than a slope or angle of 55 degrees. In some implementations, there may be some friction between surfaces 525-1, 525-2 and the movable arm 520. The friction may cause the movable arm 520 to be slowly (or relatively slowly) displaced in the in the 'X' direction (e.g., the displacement rate). Because the movable arm 520 may be slowly displaced, the first toy vehicle 365-1 and the second toy vehicle 365-2 may not launch instantly (or relatively instantly) after pressing the trigger 330. Regardless of the displacement rate of the movable arm 520, the first toy vehicle 365-1 and the second toy vehicle 365-2 will launch in the set order.

The switch 335 may be configured to select a launch order for the first toy vehicle 365-1 and the second toy vehicle 365-2. For example, as discussed above, timing mechanism 340 may include at least two time settings based on the size and/or slope or angle associated with the first portion 505 and the second portion 510. The switch 235 may be configured to alternately select one of the first portion 505 and the second portion 510 to set the displacement rate of the timing mechanism 340. The switch 335 is configured to slide in direction 'Z' (or, alternatively, opposite to direction 'Z') to select a displacement rate based on the first portion 505. In other words, the switch 335 may slide to cause the arm 515 to contact the first portion 505 as the arm 515 moves in direction 'X" during a toy vehicle launch sequence. The switch 335 is configured to slide opposite to direction 'Z' (or, alternatively, in direction 'Z') to select a displacement rate based on the second portion 510. The switch 335 is configured to move the first portion 505 and the second portion 510 in the 'Y' direction (or opposite of the 'Y' direction) in order to position one of the first portion 505 and the second portion 510 under the arm 515.

Alternatively, the switch 335 may be pushed in direction 'Y' to select a displacement rate based on the first portion 505. In other words, the switch 335 may be pushed in to cause the arm 515 to contact the first portion 505 as the arm moves in direction 'X" during a toy vehicle launch sequence. Alternatively, the switch 335 may be pulled opposite to direction 'Y' to select a displacement rate based on the second portion 510. In other words, the switch 335 may be pulled out to cause the arm 515 to contact the second portion 510 as the arm moves in direction 'X" during a toy vehicle launch sequence.

In one example implementation, if the switch 335 is pushed in (in direction 'Y'), the first toy vehicle 365-1 launches before the second toy vehicle 365-2. Further, if the switch 335 is pulled out (opposite of direction 'Y'), the first toy vehicle 365-1 launches after the second toy vehicle 365-2. In another example implementation, if the switch 335 is pushed in (in direction 'Y'), the first toy vehicle 365-1 launches after the second toy vehicle 365-2. Further, if the switch 335 is pulled out (opposite of direction 'Y'), the first toy vehicle 365-1 launches before the second toy vehicle 365-2.

Figure 6A:
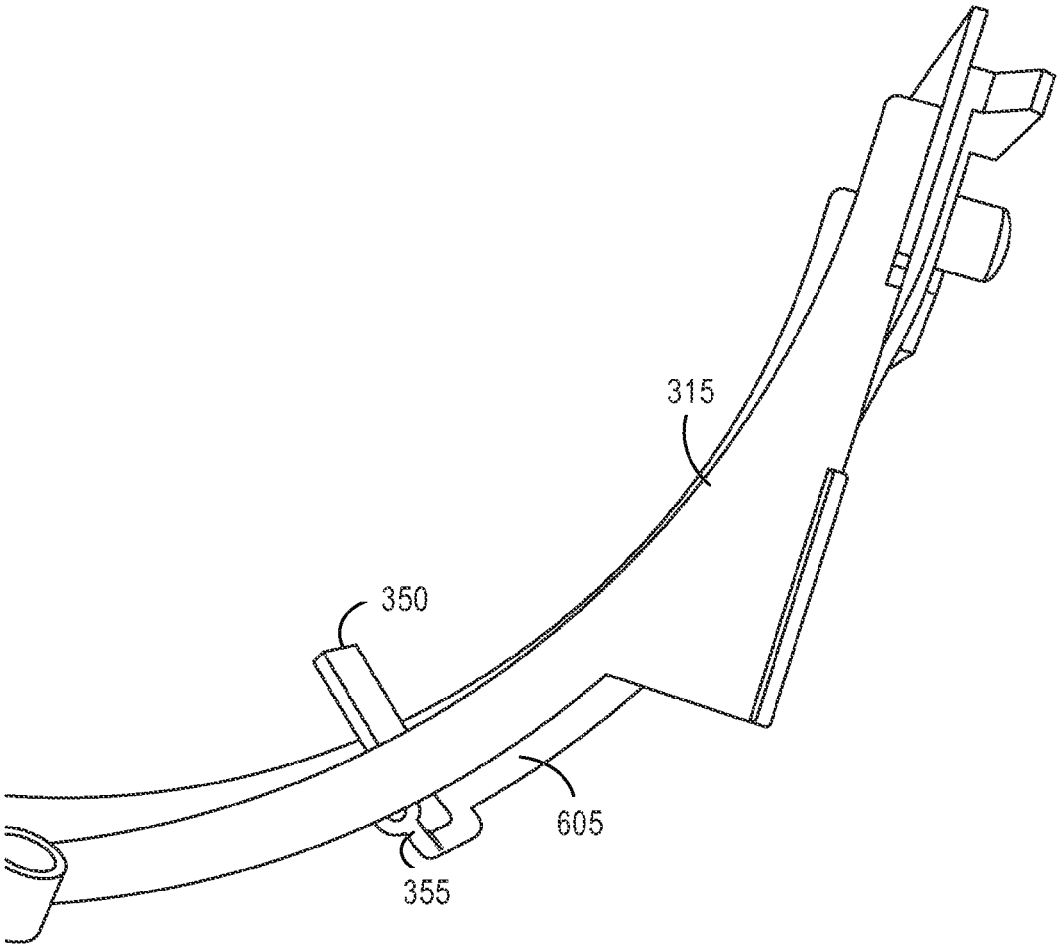
FIGS. 6A and 6B are still other perspective illustrations of a toy vehicle launcher including a launch member and a track section according to at least one example embodiment.
Figure 6B:
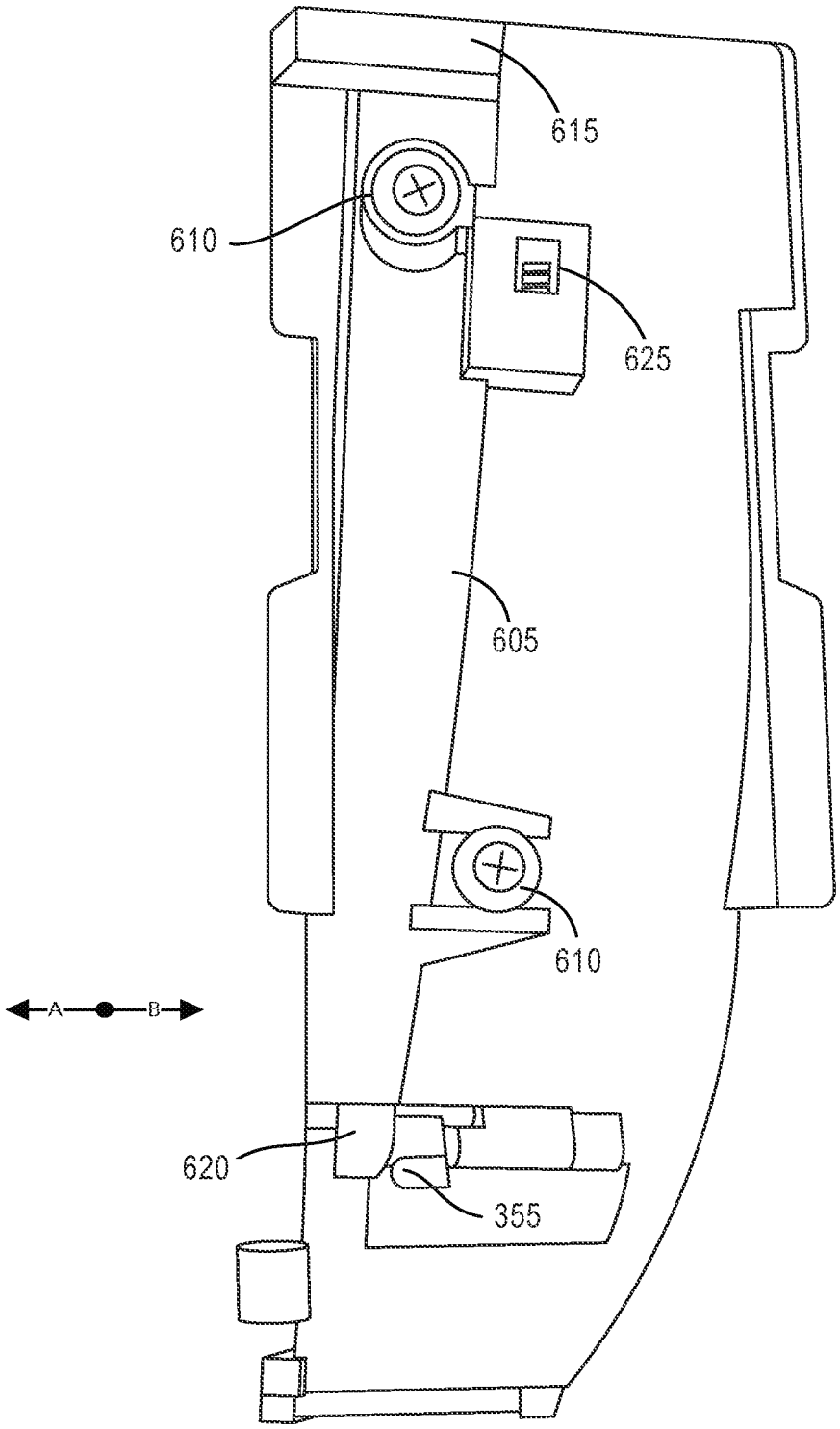

FIGS. 6A and 6B are still other perspective illustrations of a toy vehicle launcher including the launch member 350 and bottom or back side of the track section 315 according to at least one example embodiment. In FIGS. 6A and 6B, toy vehicle launcher elements, including the launch member 350, are shown removed from the toy vehicle launcher 305. As shown in FIGS. 6A and 6B, the toy vehicle launcher includes the launch member 350, track section 315, retainer 355 and arm 605. The arm 605 may be a pivot arm configured to hold (or help hold) launch member 350 in a first position. For example, the launch member 350 may be a gate and the first position may be a pre-launch (or ready) position. The arm 605 (or pivot arm) may be configured to apply a force to the retainer 355. When the force is removed (e.g., when the arm 605 is pivoted or rotated) from the retainer 355, the launch member 350 (e.g., gate) may transition to a second position. In the second position (or release position), the toy vehicle 365-2 may travel over the launch member 350 (e.g., gate) and onto track section 315.

The arm 605 may pivot on a pivot point 610. If the arm 605 is in a first position, the arm 605 may be configured to apply a force to the retainer 355. For example, if a first end 615 of the arm 605 is fully (or substantially fully) rotated in the 'A' direction, a second end 620 of the arm 605 may fully (or substantially fully) moved or rotated in the 'B' direction. When the second end 620 of the arm 605 is fully (or substantially fully) rotated in the 'B' direction, the second end 620 may be in contact with a projection of the retainer 355. As a result, a force is applied by the second end 620 to the retainer 355 such that the launch member 350 (e.g., gate) is positioned in the pre-launch (or ready) position. Further, the pivot point 610 has an associated biasing member 625. The biasing member 625 may be configured to cause the arm 605 to favor or default to the second position. For example, the biasing member 625 may include a spring configured to push the arm 605 to the second position.

If the first end 615 of the arm 605 is moved or rotated in the 'B' direction from a first position to a second position, the second end 620 of the arm 605 may fully (or substantially fully) rotated in the 'A' direction. When the second end 620 of the arm 605 is moved or rotated in the 'A' direction from the second position to the first position, the second end 620 may not be in contact with a surface of the retainer 355. As a result, no force is applied (in other words the force is removed) by the second end 620 to the retainer 355 such that the launch member 350 (e.g., gate) is positioned in the release position and the toy vehicle 365-2 may travel over the launch member 350 (e.g., gate) and onto track section 315.

Figure 7:
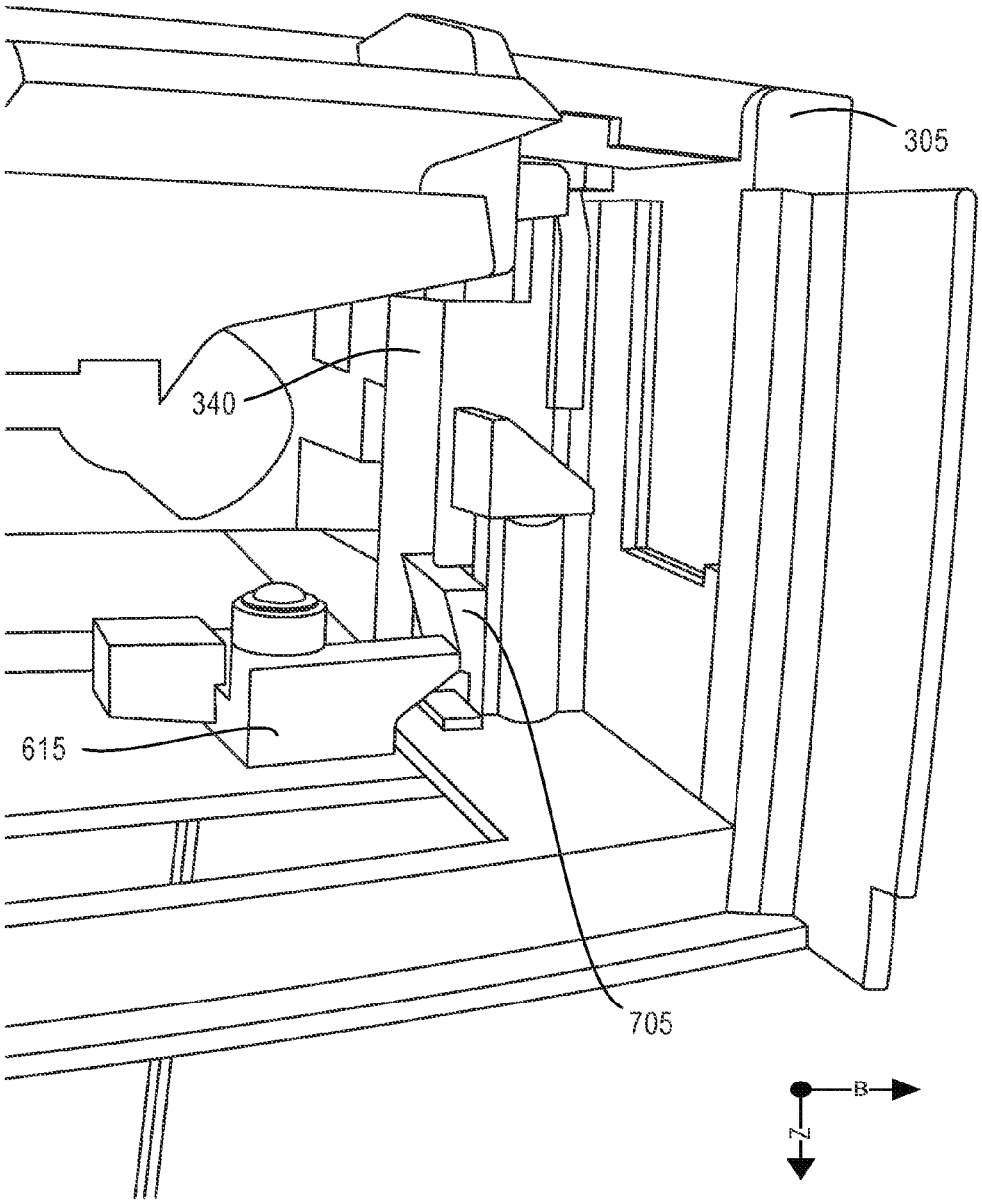
FIG. 7 is yet another perspective illustration of a toy vehicle launcher including a release mechanism according to at least one example embodiment.

FIG. 7 is yet another perspective illustration of a toy vehicle launcher according to at least one example embodiment. The toy vehicle launcher 305 includes the timing mechanism 340, the first end 615 of the arm 605 and a protrusion 705. The protrusion 705 may be an element of the timing mechanism 340. For example, the protrusion 705 may be coupled to the movable arm 520. As discussed above with regard to FIGS. 5A and 5B, during a toy vehicle launch sequence, arm 515 may come in contact with one of the first portion 505 and the second portion 510 of the timing mechanism 340. As a result, the movable arm 520 of the timing mechanism 340 may be displaced in the 'Z' direction. As a result, the protrusion 705, which may be coupled to the movable arm 520, may move in the 'Z' direction. As the protrusion 705 moves in the 'Z' direction, the first end 615 of the arm 605 is pushed in the 'B' direction causing the arm 605 to rotate. As discussed above, when the second end 620 of the arm 605 is fully (or substantially fully) rotated in the 'A' direction (as the first end 615 of the arm 605 is pushed in the 'B' direction), the second end 620 may not be in contact with a surface of the retainer 355. As a result, no force is applied by the second end 620 to the retainer 355 such that the launch member 350 (e.g., gate) may change position to the release position and the toy vehicle 365-2 may travel over the launch member 350 (e.g., gate) and onto track section 315.

Figure 8:
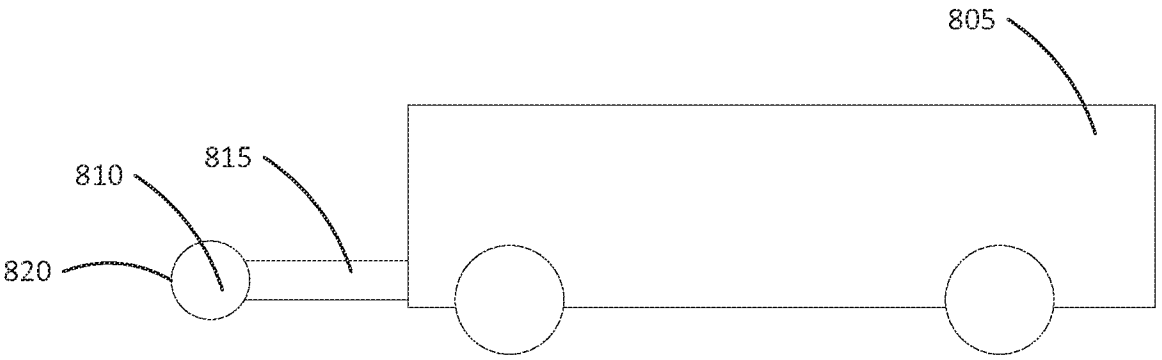
FIGS. 8 and 9 are schematic block illustrations of a toy vehicle according to at least one example embodiment.

FIG. 8 is a schematic block illustration of a toy vehicle according to at least one example embodiment. As shown in FIG. 8, the toy vehicle 805 may include a projection member 810. The projection member 810 may include an elongated portion 815 and an end portion 820. The elongated portion 815 may extend away from the toy vehicle 805. For example, one end portion of the elongated portion 815 may be coupled to a rear end portion of the toy vehicle 805. The end portion 820 may be configured to aid in the retention of toy vehicle 805 by a toy vehicle launcher (e.g., toy vehicle launcher 105, 205 and/or 305). The end portion 820 may be relatively large when compared to a width of the slot (e.g., may be larger than the width of the slot 405) in order to prevent the toy vehicle from releasing (e.g., falling) when the launch member 345 is in the pre-launch (or ready) position. The end portion 820 may be relatively small when compared to a width of the slot (e.g., may be smaller than the width of the slot 405) in order to allow the toy vehicle to release (e.g., fall) when the launch member 345 is in the launch position.

In other words, the end portion 820 is large enough to be retained by the launch member 345 when the first section 410-1 and the second section 410-2 are in contact with each other. However, as discussed above, the first section 410-1 and the second section 410-2 separate as the launch member 345 drops and the end portion 820 is small enough to release from the launch member when the first section 410-1 and the second section 410-2 separate (or substantially separate). The end portion 820 may be shaped as a sphere, a box, and the like.

Figure 9:
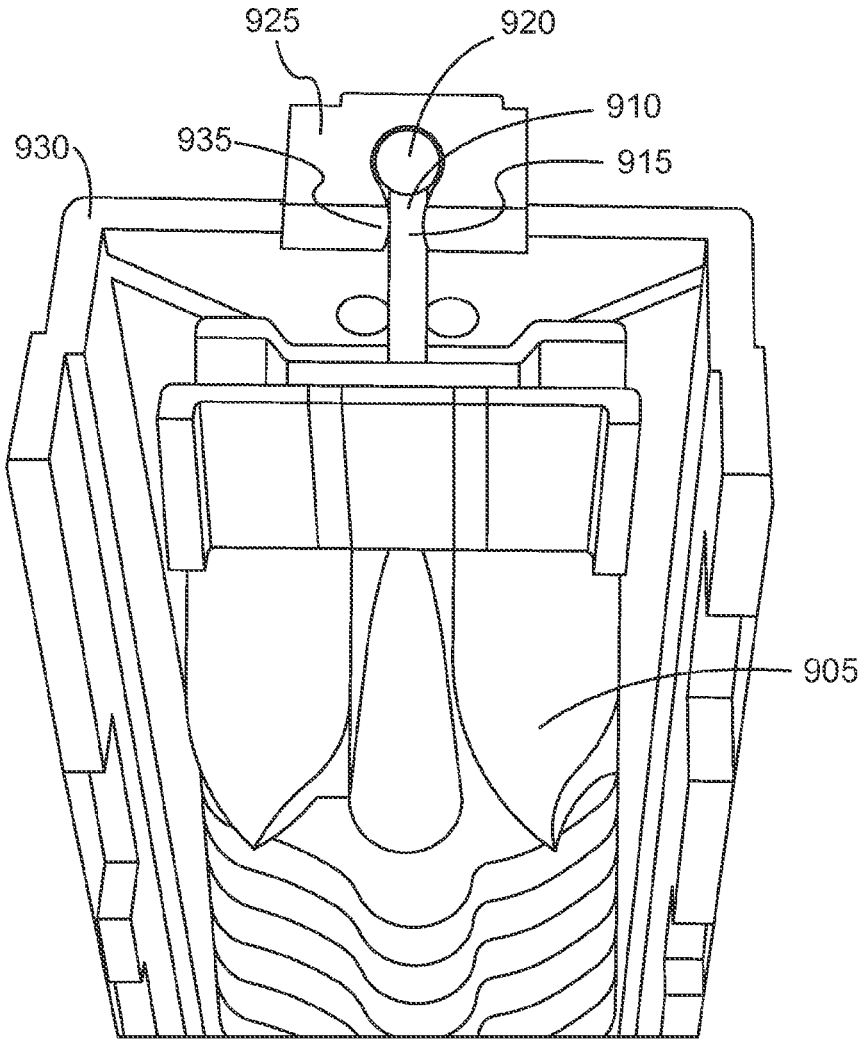

FIG. 9 is another schematic block illustration of a toy vehicle according to at least one example embodiment. FIG. 9 shows a toy vehicle 905 in a pre-launch (or ready) position (described in more detail above). As shown in FIG. 9, the toy vehicle 905 may include a projection member 910. The projection member 910 may include an elongated portion 915 and an end portion 920. The elongated portion 915 may extend away from the toy vehicle 905. For example, one end portion of the elongated portion 915 may be coupled to a rear end portion of the toy vehicle 905. The end portion 920 may be configured to aid in the retention of toy vehicle 905 by a toy vehicle launcher 930 (or toy vehicle launcher 105, 205 and/or 305). The end portion 820 may be relatively large when compared to a width of a slot 935 (e.g., may be larger than the width of the slot 935) of a launch member 925 in order to prevent the toy vehicle from releasing (e.g., falling) when the launch member 925 is in the pre-launch (or ready) position. The end portion 820 may be relatively small when compared to a width of the slot 935 (e.g., may be smaller than the width of the slot 935) in order to allow the toy vehicle to release (e.g., fall) when the launch member 925 is in the launch position.

Figure 10:
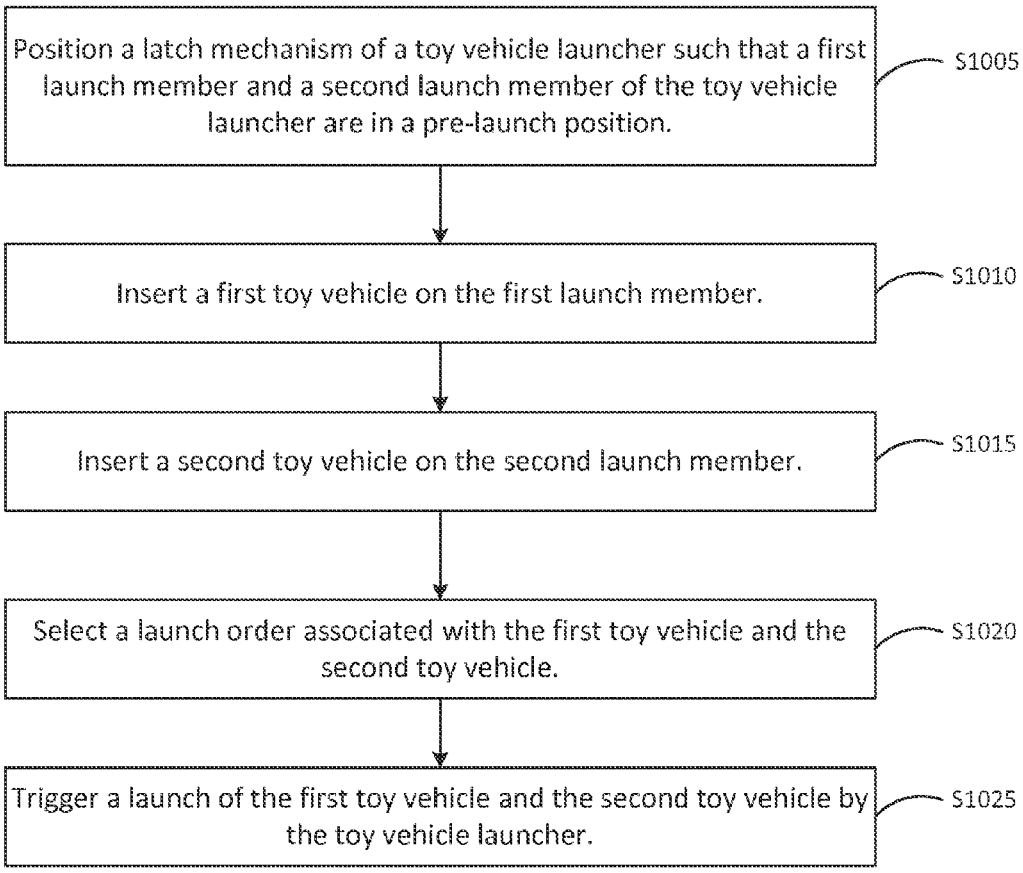
FIG. 10 is a flow diagram for a method of operating a toy vehicle launcher according to at least one example embodiment.

FIG. 10 is a method operating a toy vehicle launcher according to at least one example embodiment. The toy vehicle launcher may be the toy vehicle launcher 205 described above with regard to FIG. 2 and/or the toy vehicle launcher 305 described above with regard to FIGS. 3-7. As shown in FIG. 10, in step S1005 a latch mechanism of a toy vehicle launcher is positioned such that a first launch member and a second launch member of the toy vehicle launcher are in a pre-launch position. For example, latch mechanism 225, 325 may be positioned and locked into a position such that launch member 245, 345 and launch member 250, 350 are in a pre-launch (or ready) position.

In step S1010 a first toy vehicle is inserted on the first launch member. For example, the first toy vehicle 265-1, 365-1 may include the projection member 810 described above with regard to FIG. 8. Accordingly, the projection member 810 may be inserted in slot 405 of launch member 345. As a result, the first toy vehicle 265-1, 365-1 may hang from launch member 345 in a pre-launch (or ready) position.

In step S1015 a second toy vehicle is inserted on the second launch member. For example, the second toy vehicle 265-2 may be positioned against launch member 250, 350. The latch mechanism 225, 325 may be positioned such that launch member 250, 350 as a gate may prevent the second toy vehicle 265-2 from travelling onto track sections 215, 315.

In step S1020 a launch order associated with the first toy vehicle and the second toy vehicle is selected. For example, switch 235, 335 may be positioned to select the launch order. For example, as discussed above, in one example implementation, if the switch 235, 335 is pushed in, the first toy vehicle 365-1 launches before the second toy vehicle 365-2. Further, if the switch 335 is pulled out, the first toy vehicle 365-1 launches after the second toy vehicle 365-2. In another example implementation, if the switch 335 is pushed in, the first toy vehicle 365-1 launches after the second toy vehicle 365-2. Further, if the switch 335 is pulled out, the first toy vehicle 365-1 launches before the second toy vehicle 365-2.

In step S1025 a launch of the first toy vehicle and the second toy vehicle by the toy vehicle launcher is triggered. For example, trigger 230, 330 may be pushed to trigger the launch. Triggering the launch may cause the launch member 245, 345 to launch or release the first toy vehicle 265-1, 365-1 and launch member 250, 350 to launch or release the second toy vehicle 265-2, 365-2. The first toy vehicle 265-1, 365-1 and the second toy vehicle 265-2, 365-2 may launch onto and travel on the track section 210, 310 and the track section 215, 315 respectively. The first toy vehicle 265-1, 365-1 and the second toy vehicle 265-2, 365-2 may continue to eventually simultaneously (or substantially simultaneously) travel on the track section 220, 320.

Specific structural and functional details disclosed herein are merely representative for purposes of describing example embodiments. Example embodiments, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Lastly, it should also be noted that whilst the accompanying claims set out particular combinations of features described herein, the scope of the present disclosure is not limited to the particular combinations hereafter claimed, but instead extends to encompass any combination of features or embodiments herein disclosed irrespective of whether or not that particular combination has been specifically enumerated in the accompanying claims at this time.

We claim:

1. A toy vehicle track system, comprising:

a first track section;

a second track section;

a third track section;

a trigger configured to initiate a launch of both a first toy vehicle and a second toy vehicle upon a single actuation of the trigger by a user; and a toy vehicle launcher operatively coupled to the trigger and configured to launch both the first toy vehicle onto the first track section and configured to launch the second toy vehicle onto the second track section upon the single operation of the trigger by the user;

the third track section being configured to receive the first toy vehicle from the first track section and configured to receive the second toy vehicle from the second track section such that the first toy vehicle and the second toy vehicle simultaneously travel on the third track section.

2. The toy vehicle track system of claim 1, wherein the toy vehicle launcher configured to sequentially launch the first toy vehicle and the second toy vehicle upon the single operation of the trigger by the user.

3. The toy vehicle track system of claim 1, wherein the toy vehicle launcher can be placed in a first configuration and a second configuration based on a desired order of launch of the first toy vehicle and the second toy vehicle.

4. The toy vehicle track system of claim 1, wherein the toy vehicle launcher includes a timing mechanism configured to delay a release of at least one of the first toy vehicle and the second toy vehicle.

5. The toy vehicle track system of claim 1, wherein the toy vehicle launcher includes a timing mechanism having a movable arm including a first portion and a second portion, the first portion and the second portion each defining a corresponding displacement rate for the movable arm.

6. The toy vehicle track system of claim 1, wherein the toy vehicle launcher includes a timing mechanism having a movable arm, and a displacement rate associated with the movable arm corresponds to an amount of friction between a surface of the timing mechanism and the movable arm.

7. The toy vehicle track system of claim 1, wherein the toy vehicle launcher includes a launch member configured to hold the first toy vehicle when the launch member is in a first position and configured to release the first toy vehicle onto the first track section when the launch member is in a second position.

8. The toy vehicle track system of claim 1, wherein the toy vehicle launcher includes a launch member configured to hold the second toy vehicle when the launch member is in a first position and configured to release the second toy vehicle onto the second track section when the launch member is in a second position.

9. The toy vehicle track system of claim 1, wherein the toy vehicle launcher includes:

a first launch member configured to hold the first toy vehicle when the first launch member is in a corresponding first position and configured to release the first toy vehicle onto the first track section when the first launch member is in a corresponding second position; and a second launch member configured to hold the second toy vehicle when the second launch member is in a corresponding first position and configured to release the second toy vehicle onto the second track section when the second launch member is in a corresponding second position.

10. The toy vehicle track system of claim 1, wherein the toy vehicle launcher includes:

a launch member configured to hold the second toy vehicle when the launch member is in a first position and configured to release the second toy vehicle onto the second track section when the launch member is in a second position; and a switch operably coupled to the toy vehicle launcher, the switch configured to select a launch order for the first toy vehicle and the second toy vehicle.

11. The toy vehicle track system of claim 1, wherein the toy vehicle launcher includes:

a first launch member configured to hold the first toy vehicle when the first launch member is in a first position and configured to release the first toy vehicle onto the first track section when the first launch member is in a second position;

a second launch member configured to hold the second toy vehicle when the second launch member is in a first position and configured to release the second toy vehicle onto the second track section when the second launch member is in a second position;

a first retainer configured to hold the first launch member in the corresponding first position of the first launch member;

a second retainer configured to hold the second launch member is in the corresponding first position of the second launch member;

a trigger configured to release the first retainer and the second retainer; and a timing mechanism configured to delay a release of at least one of the first toy vehicle and the second toy vehicle as compared to a release of the other of the first toy vehicle and the second toy vehicle.

12. The toy vehicle track system of claim 1, wherein the toy vehicle launcher includes:

a switch operably coupled to the toy vehicle launcher, the switch configured to select a launch order for the first toy vehicle and the second toy vehicle.

13. A toy vehicle launcher, comprising:

a first launch member configured to launch a first toy vehicle;

a second launch member configured to launch a second toy vehicle;

a trigger configured to initiate a launch of both the first toy vehicle and the second toy vehicle upon a single actuation of the trigger by a user; and a switch operably coupled to the first launch member and the second launch member, the switch configured to select a launch order of the first toy vehicle and the second toy vehicle upon the single actuation of the trigger by a user.

14. The toy vehicle launcher of claim 13, wherein the second launch member includes:

a first timing mechanism configured to cause the second launch member to launch the second toy vehicle at before a time the first launch member launches the first toy vehicle; and a second timing mechanism configured to cause the second launch member to launch the second toy vehicle after the time the first launch member launches the first toy vehicle, wherein the switch is configured to select one of the first timing mechanism and the second timing mechanism for use in launching the first toy vehicle and the second toy vehicle.

15. The toy vehicle launcher of claim 13, wherein the second launch member includes:

a gate configured to hold the second toy vehicle in a pre-launch position;

a timing mechanism operably connected to the gate, the timing mechanism configured to position the gate in a launch position based on a time the first vehicle is launched by the first launch member.

16. The toy vehicle launcher of claim 13, wherein the second launch member includes:

a pivot arm configured to hold a gate in a first position; and a timing mechanism operably connected to the pivot arm by a push arm, the push arm configured to cause the pivot arm to move the gate to a second position.

17. A toy vehicle track system comprising:

a launcher, comprising:

a first launch member configured to launch a first toy vehicle;

a second launch member configured to launch a second toy vehicle;

a trigger configured to initiate a launch of both the first toy vehicle and the second toy vehicle upon a single actuation of the trigger by a user; and a timing mechanism configured to delay a release of the first toy vehicle and the second toy vehicle upon the single actuation of the trigger by a user.

18. The toy vehicle track system of claim 17, further comprising:

a first track section;

a second track section;

a third track section;

wherein the launcher is configured to launch the first toy vehicle onto the first track section and configured to launch the second toy vehicle onto the second track section, and the third track section being configured to receive the first toy vehicle from the first track section and configured to receive the second toy vehicle from the second track section such that the first toy vehicle and the second toy vehicle simultaneously travel on the third track section.

19. The toy vehicle track system of claim 17, wherein the toy vehicle launcher further includes:

a switch operably coupled to the toy vehicle launcher, the switch configured to select a launch order for the first toy vehicle and the second toy vehicle.

20. The toy vehicle track system of claim 19, wherein the second launch member includes:

a first timing mechanism configured to cause the second launch member to launch the second toy vehicle at before a time the first launch member launches the first toy vehicle; and a second timing mechanism configured to cause the second launch member to launch the second toy vehicle after the time the first launch member launches the first toy vehicle, wherein the switch is configured to select one of the first timing mechanism and the second timing mechanism for use in launching the first toy vehicle and the second toy vehicle.

* * * * *